US005974695A

United States Patent [19]

Slepian et al.

[11] Patent Number: 5,974,695

[45] Date of Patent: Nov. 2, 1999

[54] COMBINATION MIDSOLE STABILIZER AND ENHANCER

[76] Inventors: Neil Slepian, 12 Fairchild Dr., Durham, N.H. 03824; Michael Kirk, 17A Read St., Salem, Mass. 01970; Joseph Hamill, 1300 Burts Pit Rd., Florence, Mass. 01060; Kenton Geer, 14 Walnut St., Exeter, N.H. 03833

[21] Appl. No.: 09/172,839

[22] Filed: Oct. 15, 1998

Related U.S. Application Data

[63] Continuation of application No. 08/926,813, Sep. 9, 1997, Pat. No. 5,852,886, which is a continuation of application No. 08/582,681, Jan. 4, 1996, Pat. No. 5,729,917.

[51] Int. Cl.[6] ..... A43B 13/18

[52] U.S. Cl. ..... 36/27; 36/28; 36/30 R; 36/35 R

[58] Field of Search ..... 36/27, 28, 30 R, 36/35 R, 7.8, 37, 38, 25 R, 114

[56] References Cited

U.S. PATENT DOCUMENTS

| | | |
|---|---|---|
| 2,001,821 | 5/1935 | Everston . |
| 2,677,906 | 5/1954 | Reed . |
| 3,724,106 | 4/1973 | Magidson . |
| 3,798,801 | 3/1974 | Gros-Louis . |
| 4,180,924 | 1/1980 | Subotnick . |
| 4,297,797 | 11/1981 | Meyers . |
| 4,364,188 | 12/1982 | Turner et al. . |
| 4,364,189 | 12/1982 | Bates . |
| 4,445,283 | 5/1984 | Meyers . |
| 4,506,462 | 3/1985 | Cavanagh . |
| 4,598,487 | 7/1986 | Misevich . |
| 4,627,177 | 12/1986 | Meyers . |
| 4,815,221 | 3/1989 | Diaz . |
| 4,878,301 | 11/1989 | Kiyosawa . |
| 4,890,397 | 1/1990 | Harada . |
| 5,070,629 | 12/1991 | Graham et al. . |
| 5,402,588 | 4/1995 | Graham et al. . |
| 5,595,002 | 1/1997 | Slepian et al. . |
| 5,680,714 | 10/1997 | Lopez . |
| 5,729,917 | 3/1998 | Slepian et al. . |
| 5,852,886 | 12/1998 | Slepian et al. . |

FOREIGN PATENT DOCUMENTS

| | | |
|---|---|---|
| 0 352 807 A2 | 1/1990 | European Pat. Off. . |
| 0 353 430 A2 | 7/1990 | European Pat. Off. . |
| 0 510 943 A2 | 10/1992 | European Pat. Off. . |
| 11 36 913 | 9/1962 | Germany . |
| 88 07 671 U | 9/1988 | Germany . |
| 2 243 530 | 11/1991 | United Kingdom . |

*Primary Examiner*—Ted Kavanaugh
*Attorney, Agent, or Firm*—Wolf, Greenfield & Sacks, P.C.

[57] ABSTRACT

A structure for enhancing the stability of a midsole including a plurality of strands which extend from a position on top of the midsole to a location secured to the bottom of the midsole. The strands are preferably secured to an energy return system which is positioned on the top of the midsole. The initial strike imparted on the lateral side of the midsole compresses both the midsole and the strands. The strands, which separate during the initial strike from the midsole and assume an arcuate shape, enhance the shock absorbing properties of the shoe. As the foot rotates, the heel exerts pressure on the energy return system, and the strands are then pulled inwardly thereby restricting the outward movement of the midsole. The foot is further unlikely to assume a substantially pronated position due to the tension in the strands along the medial portion of structure in combination with the shock absorption upon initial strike.

10 Claims, 9 Drawing Sheets

COMBINATION MIDSOLE STABILIZER AND ENHANCER

This application is a continuation of application Ser. No. of 08/926,813, filed on Sept. 9, 1997, now U.S. Pat. No. 5,852,886 which is a continuation of application Ser. No. 08/582,681, filed on Jan. 4, 1996, now U.S. Pat. No. 5,729,917.

FIELD OF THE INVENTION

The present invention relates to a shoe construction and more particularly to a shoe having a combination midsole stabilizer encompassing the lateral and medial portions of the midsole and means for maintaining the stability of the midsole by utilizing forces imparted on the midsole.

BACKGROUND OF THE INVENTION

Biomechanics has taught that the running gait cycle begins with the heel strike, that is, when the foot first impacts the ground. The foot first strikes the ground along a lateral portion of the heel in a supinated position. As the gait cycle continues, the foot rotates substantially transverse or inward through the midstance position toward the medial portion of the foot. When the foot moves to the medial portion, it is in the pronated phase. The final phase of the gait is the return of the foot to the center position as the runner pushes off.

There have been several inventions in recent years relating to the lateral side of the midsole in an attempt to assist runners and other athletes in a variety of manners. For example, there are a series of invention relating to methods to mitigate the likelihood of overpronation. Some of these inventions include varying the material compressibility on the lateral side in comparison to the material in the center and medial portions of the midsole. Other structures to lessen overpronation include the use of wedges to absorb the impact of the initial strike to slow the foot down as it begins to move transversely.

In addition, there have been attempts over the years to develop energy return systems and stabilizers in the center portion of the midsole. U.S. Pat. No. 5,070,629, issued Dec. 10, 1991, describes a sweet spot sole construction comprising a plurality of fibers forming a net under tension. The purpose of this system helps support the heel portion of the foot and provides energy return features as the runner complete the cycle and begins to push off.

After extended use, particularly after long distance running, the midsole region of the shoe begins to lose its shape and resiliency thus becoming less stable for the user. In fact, after repeated strikes, the midsole may become deformed into a pattern reflecting the wearer's particular gait. The forces on the midsole by the foot are not only downward, but also have horizontal components. Without any control on the midsole, other than the resiliency of the midsole material, the midsole will lose its shape over time.

Most often, the only solution for a deformed midsole is to simply throw out the sneakers and buy a new pair. Runners generally find that a pair of sneakers has a mileage limitation such as, for example, 500–1000 miles, after which the runner discards the sneakers for a new pair. When the sneakers reach the mileage limitation, the sneakers tend to no longer provide the support or resiliency necessary for top performance. The shoes are also no longer comfortable and the impact with the ground during each strike becomes more and more noticeable. The source of the mileage limitation is often the functional lifetime of the midsole.

There are several problems with this arrangement. First, top quality running sneakers are not inexpensive. Replacing sneakers every three or four months can be both costly and frustrating as the runner attempts to fine a new satisfactory pair. In addition, the runner or athlete often develops a particular fondness for his or her pair of sneakers after spending time "breaking in" other components of the shoe such as the vamp and other parts of the upper. For aesthetic reasons as well, people become attached to a particular pair of sneakers on the one hand while it is not unusual for a manufacturer to discontinue a style after one or two years on the market.

Increasing the effective functional life of a pair of sneakers is also an important factor when sneakers are used for competitive purposes. For a runner in a long distance competition, the need for a comfortable upper as well as a properly functioning midsole is important.

SUMMARY OF THE INVENTION

It is an object of the present invention to provide a structure that increases the functional life of a midsole in athletic footwear.

It is another object of the present invention to provide a structure that increases the functional life of a midsole by utilizing the user's striking force imparted on the sneaker.

It is still a further object of the present invention to provide a shoe having a midsole which substantially retains its elastic features after prolonged use.

It is still a further object of the present invention to provide a shoe having a midsole with both stabilizing characteristics and a midsole having prolonged life.

It is still a further object of the present invention to provide a shoe having stabilizing features along the lateral and medial sides of a shoe to support the foot during first strike.

It is still a further object of the present invention to provide a shoe having stabilizing characteristics throughout the gait cycle.

It is still a further object of the present invention to provide a combination stabilizing midsole and midsole enhancing construction.

The present invention comprises a plurality of strands which extend from a position on top of the midsole to a location secured to the bottom of the midsole. The strands are preferably secured to an energy return system which is positioned on the top of the midsole. The strike imparted on the lateral side of the midsole compresses both the midsole and the strands. The strands, which separate from the midsole and assume an arcuate shape upon initial strike, enhance the shock absorbing properties of the shoe. As the foot rotates, the heels exert pressure on the energy return system, and the strands are then pulled inwardly thereby restricting outward movement of the midsole.

These and other objects and advantages of the present invention will be more clearly understood when considered in conjunction with the accompanying drawings, in which:

DETAILED DESCRIPTION OF THE DRAWINGS

Figure 9:
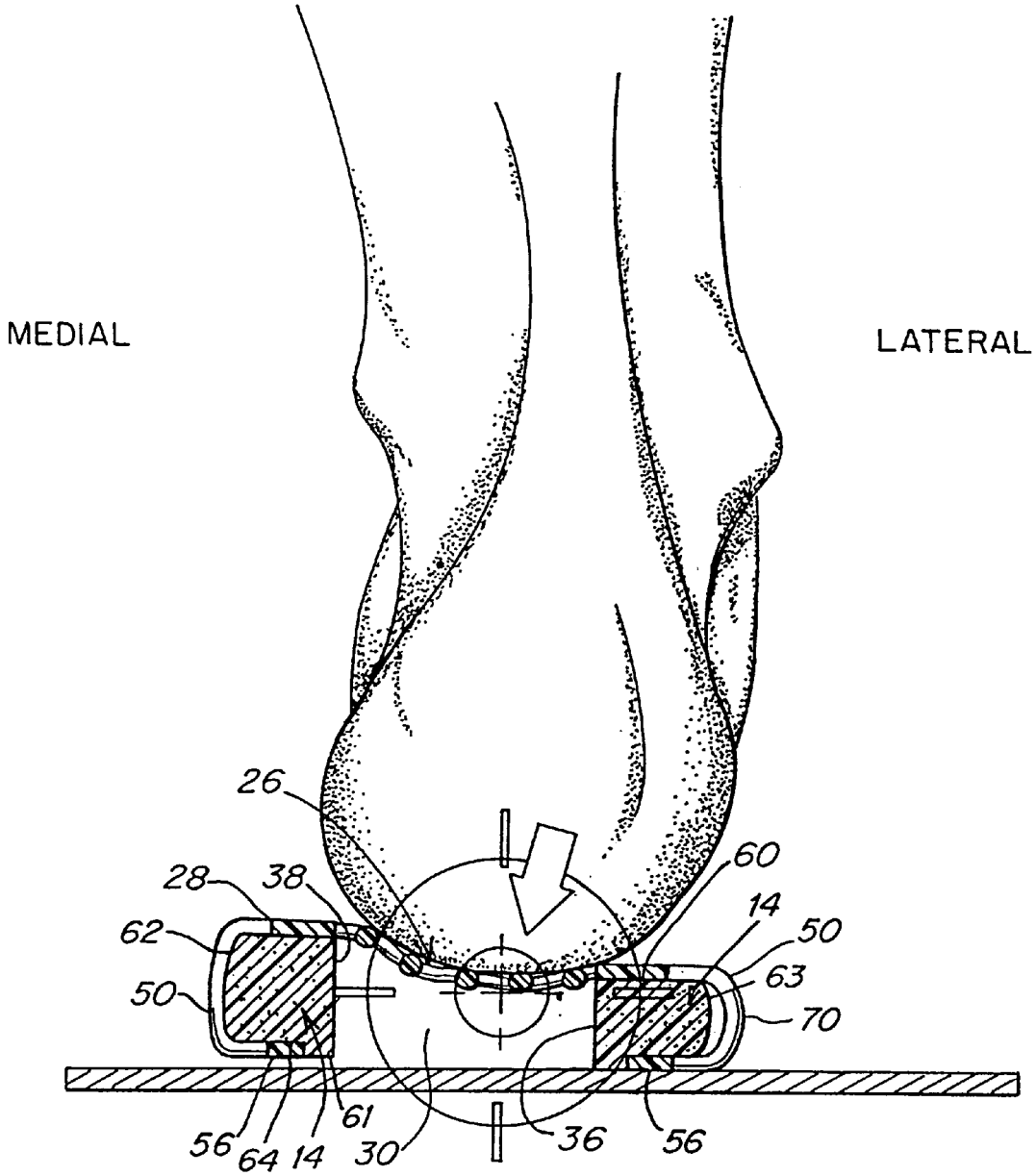
FIG. 9 is a plan end view of the present invention at the beginning of the runner's gait cycle.
Figure 10:
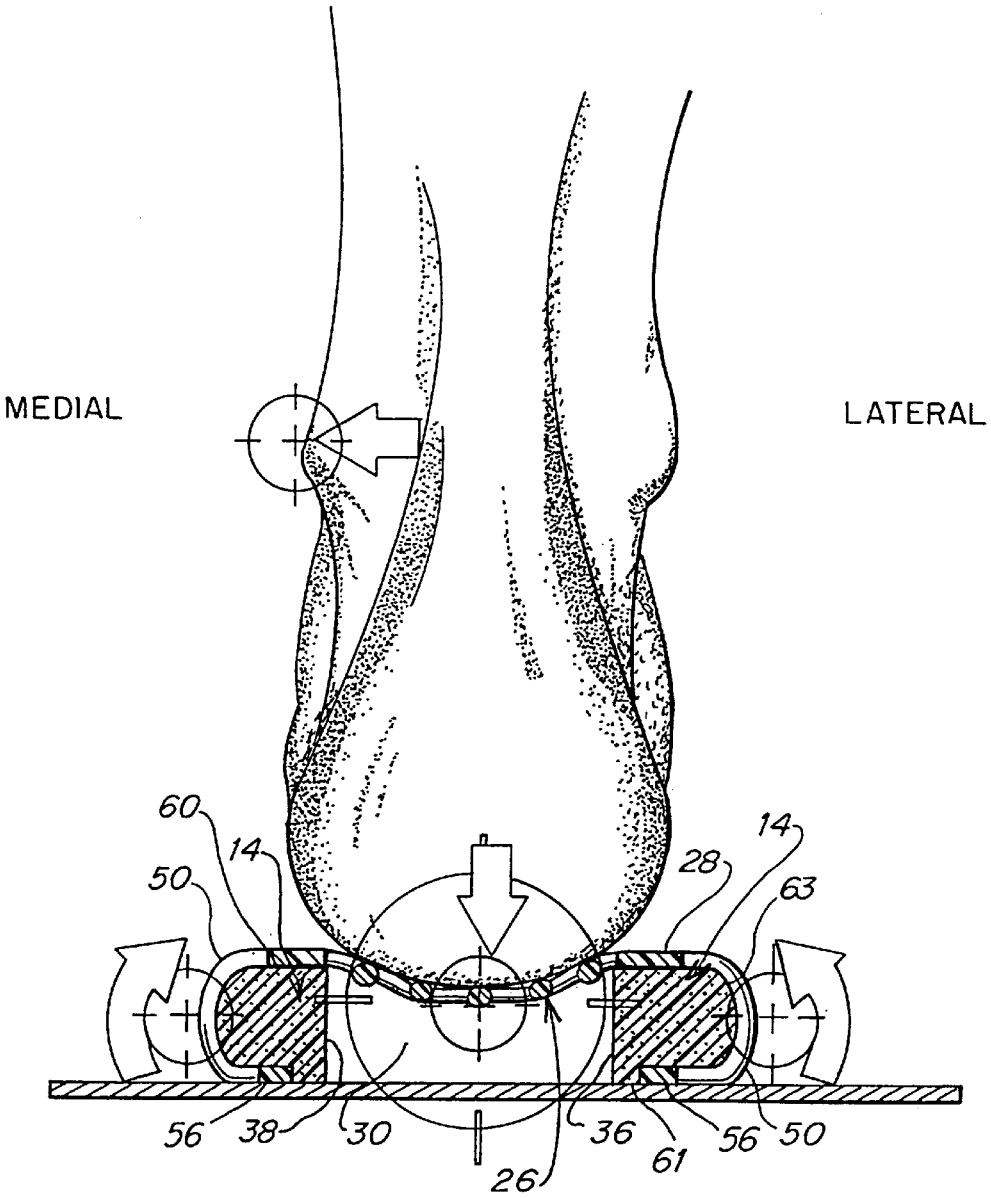
Figure 11:
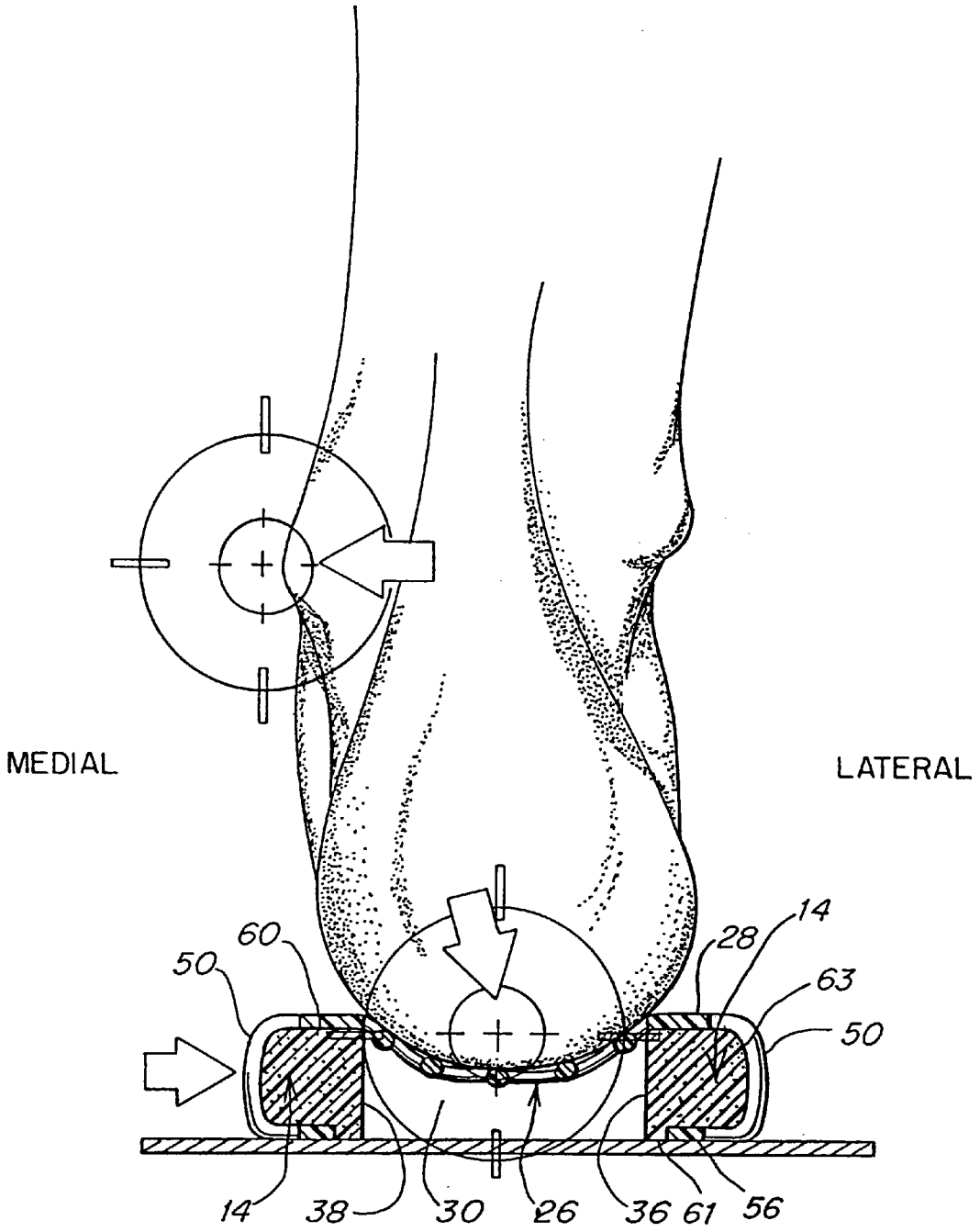
Figure 12:
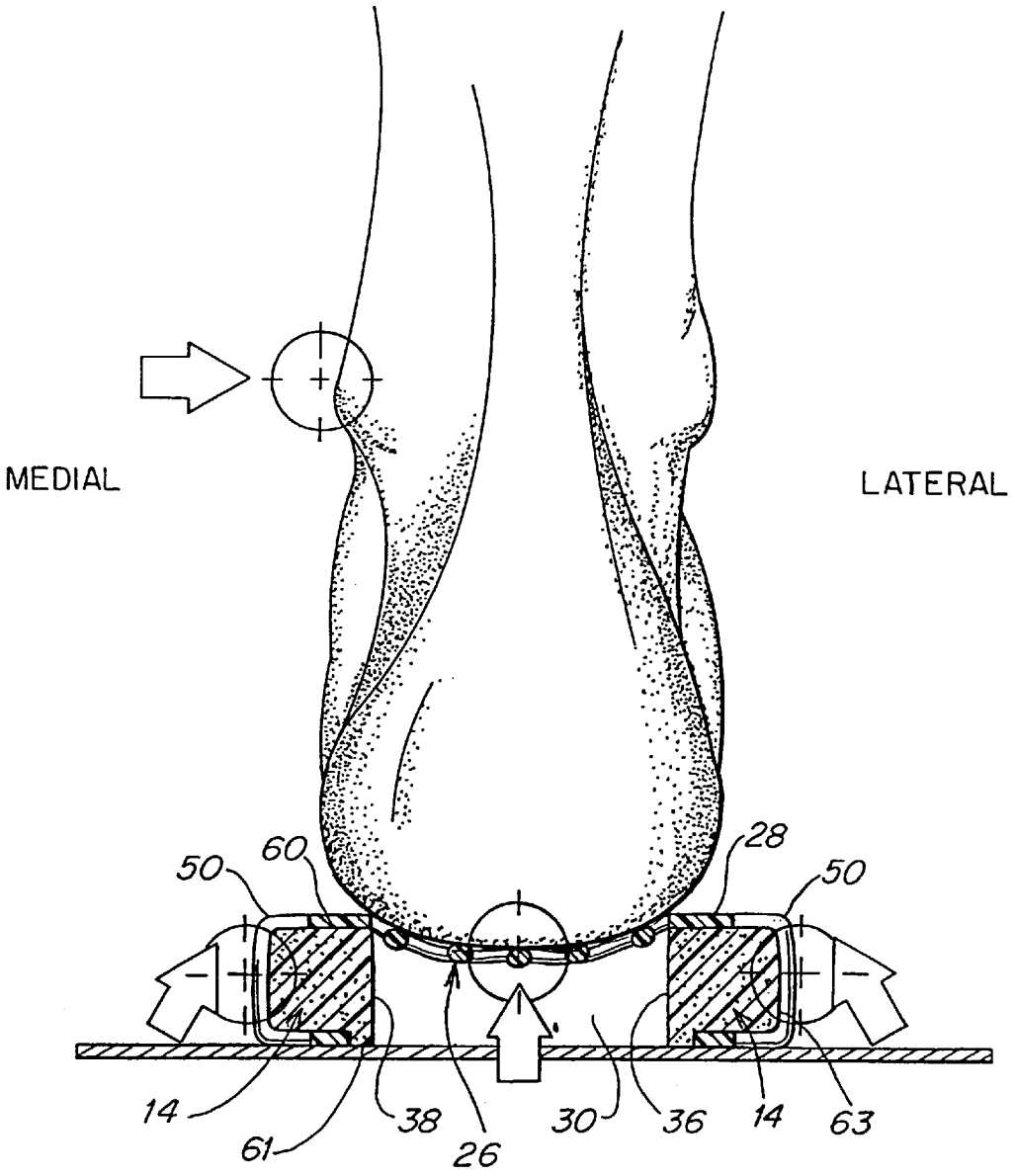

FIG. 10 sequentially follows FIG. 9 illustrating the invention as the heel becomes aligned with the energy return cassette;

FIG. 11 sequentially follows FIG. 10 illustrating the invention as the foot begins to slightly pronate; and FIG. 12 sequentially follows FIG. 11 illustrating the invention as the gait cycle finishes and the runner pushes off.

DETAILED DESCRIPTION OF THE PRESENT INVENTION

Figure 1:
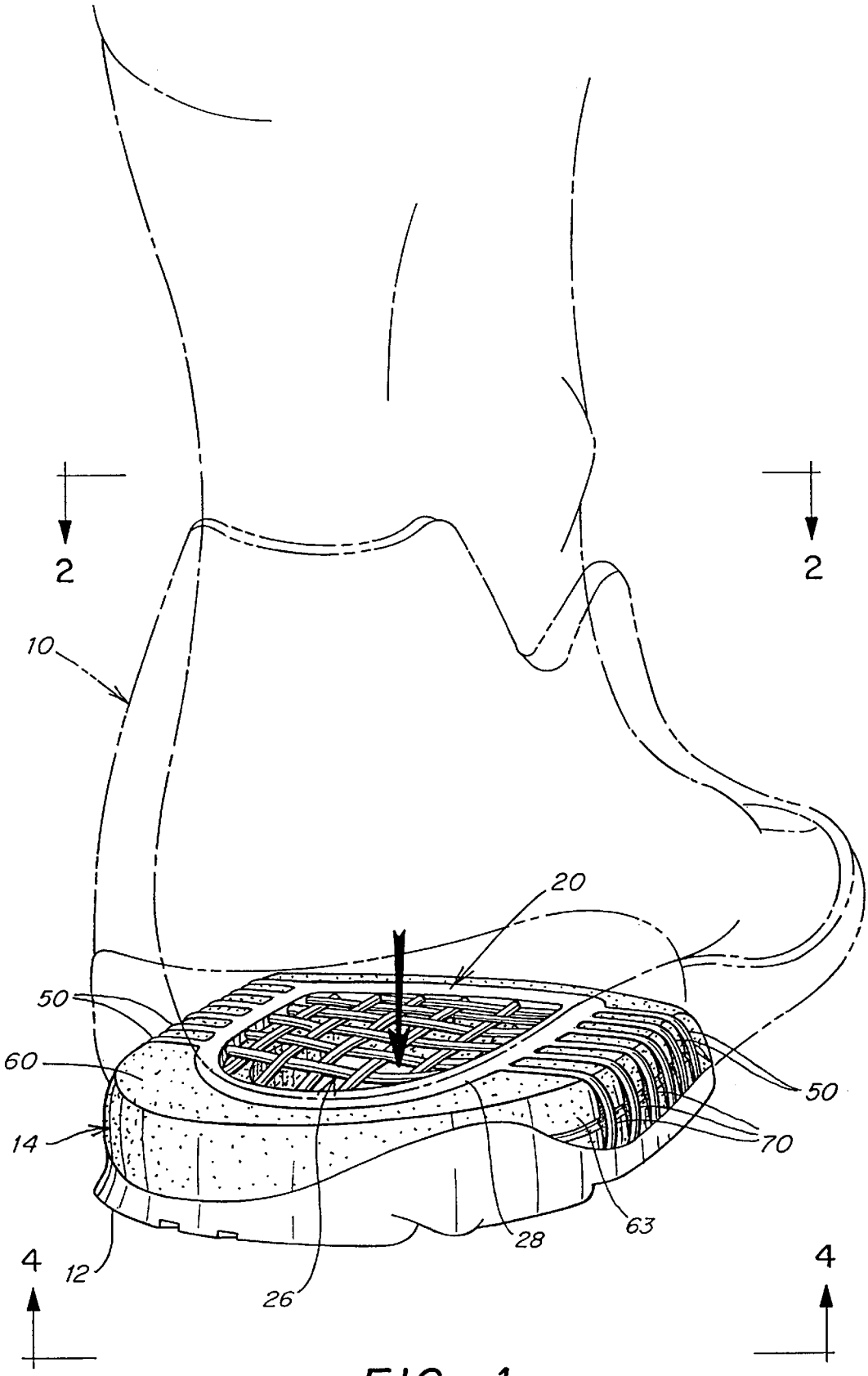
FIG. 1 is a perspective view of the midsole region of a running shoe including the present invention.

The overall arrangement of the present invention may be best seen in FIG. 1 which illustrates the present invention in use in a shoe structure 10. While the present invention is described in terms of a running shoe, the present invention may be applied to any type of shoe, but preferably athletic footwear. As with most footwear, the illustrated shoe 10 includes standard components—the sole or outersole 12, the midsole 14, and the inner sole (not shown) which is located above the midsole 14. Typically, the wearer's foot would rest on the inner sole.

The energy return cassette 20 illustrated as part of the preferred embodiment of the present invention may include the use of components in the midsole region which provide enhanced cushioning and energy return characteristics. These components may be selectively embodied in the heel, midfoot and/or forepart of the midsole to achieve desired energy return characteristics designed for a particular type of shoe. These components may be especially designed for use in walking shoes or various specific types of athletic shoes such as basketball or running shoes which undergo a substantial number of strikes. The preferred embodiment includes the use of the energy return cassette 20 in conjunction with the heel region of the midsole 14. Of course the cassette 20 may be disposed at other locations of the sole. Various features of the energy return cassette 20 is the subject of other patents, including U.S. Pat. Nos. 5,070,629 and 5,402,588 both of which are incorporated herein by reference.

Figure 6:
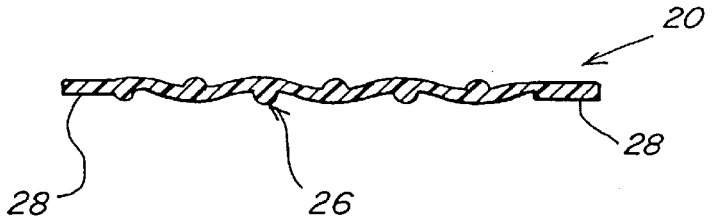
FIG. 6 is across-section of the invention taken along the lines 6—6 of FIG. 5.
Figure 7:
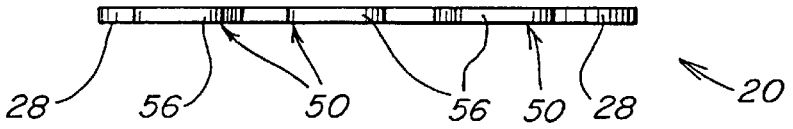
FIG. 7 is a plan side view of the invention taken along the lines 7—7 of FIG. 5.
Figure 8:
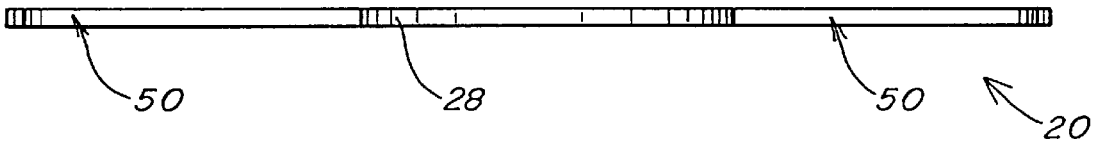
FIG. 8 is a plan end view of the invention taken along the lines 8—8 of FIG. 5.

For reference purposes for this description, the energy return cassette 20 generally comprises a net region 26 and a frame or perimeter 28. In the embodiment shown, the cassette 20 is a flat thermoplastic piece, molded to integrally include the net 26 and frame 28. The frame 28 may have a closed loop perimeter or an open loop such as a horseshoe shape. As seen in FIGS. 6–8, the cassette 20 is not thick.

Figure 2:
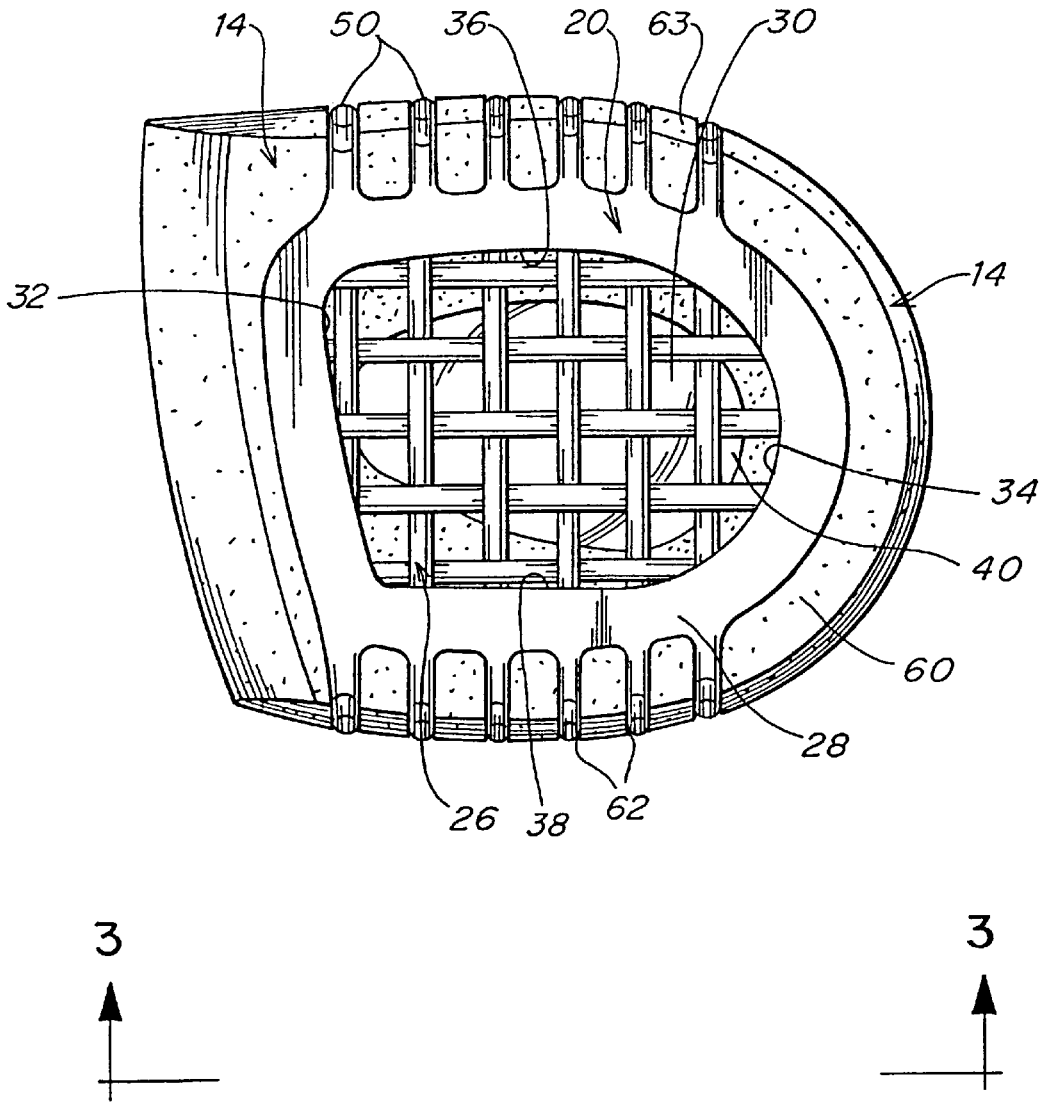
FIG. 2 is a top view of the midsole region taken along the lines 2—2 of FIG. 1.

The cassette 20 is positioned directly on the midsole 14. In the present arrangement, the midsole 14 includes a void 30 into which the net region 26 is deflected as the user exerts force on the net region 26. As shown in FIG. 2, the void 30 is defined by front, back, and sidewalls, 32, 34, 36, 38 of the midsole 14. The midsole 14 is made from any number of typical materials including EVA, polyurethane, and a combination of both materials. In addition, while the present invention illustrates sidewalls of the void 30 in vertical alignment with the net region 26, the walls may be angled. Further, it is within the scope of this invention to provide a midsole 14 having a variety of compressible materials in the void location.

Primarily for aesthetic purposes, the present embodiment also includes a dome or window 40 in vertical alignment with the net region 26 and void 30. The dome 40 provides a means by which the energy return cassette 20, primarily the net region 26, may be viewed. The dome 40 preferably has a base perimeter which is coplanar with the sole 12.

The basic components of the present invention comprise a series of legs or strands 50 which are shown in the preferred embodiment extending outwardly from the frame 28 of the energy return cassette 20. It is farther preferred that the strands 50 are molded integrally with the cassette 20 itself. Thus, the strands 50 are typically manufactured from the same materials as the cassette 20. In addition, as seen in FIGS. 7 and 8, the strands 50 have a height which corresponds to the height of the other components of the energy return cassette 20.

Figure 5:
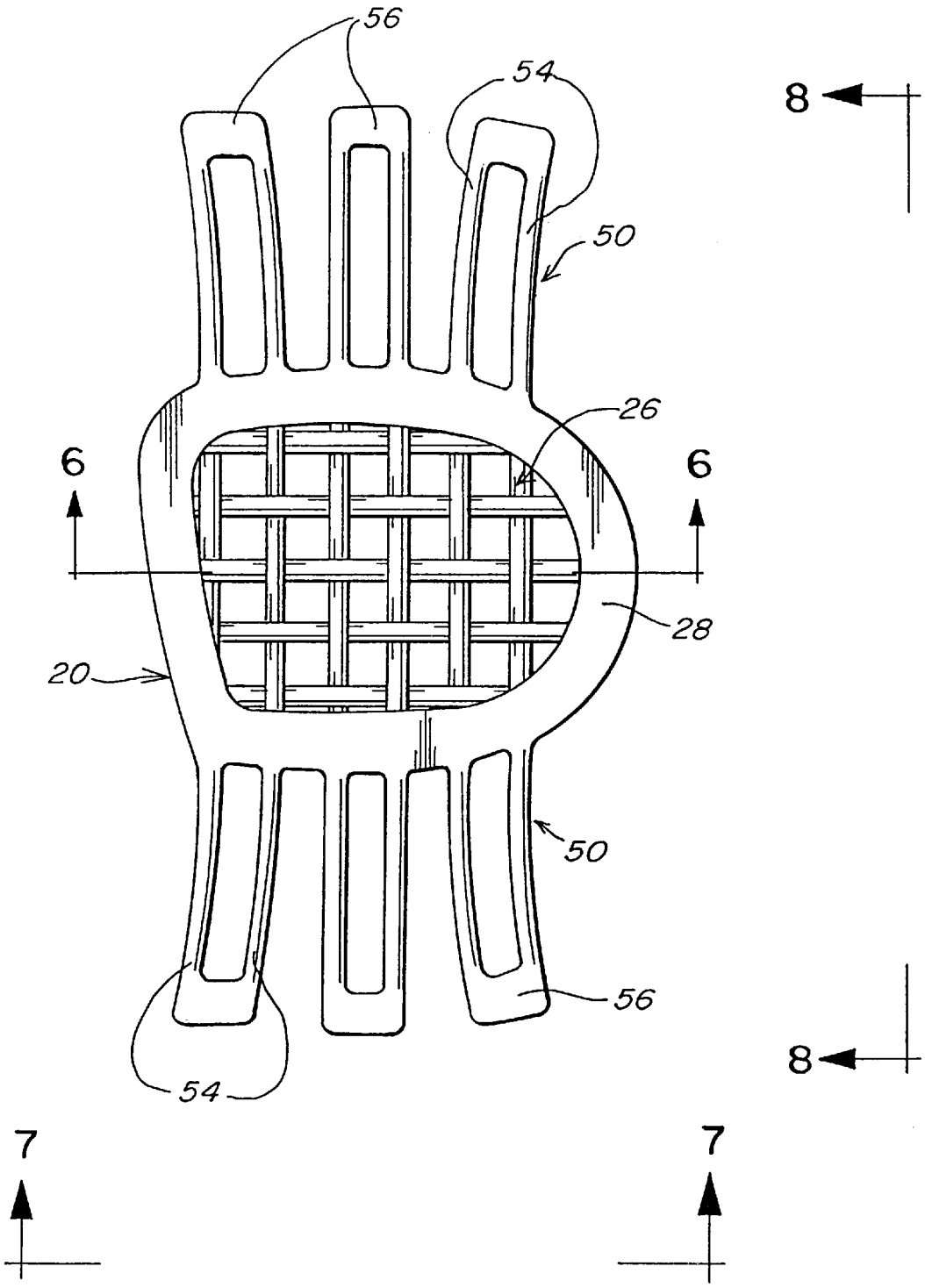
FIG. 5 is a top view of the present invention including the energy return system prior to mounting on the midsole region.

As best seen in FIG. 5, the strands 50 extend in paired arrangements 54 from the frame 28. Each strand 50 of the respective pairs 54 is in substantially coplanar parallel alignment with one another. The strands 50 are integrally connected to one another by a cap section 56 located approximately at right angles to respective strands 50.

In the preferred arrangement, the cassette 20 may secured to the upper surface 60 of the midsole 14 by any number of adhesives that are readily known in the art. In addition, the cassette 20 may be frictionally secured in position by molding a lock-in arrangement of the cassette 20 into the upper surface 60 of the midsole 14.

Figure 3:
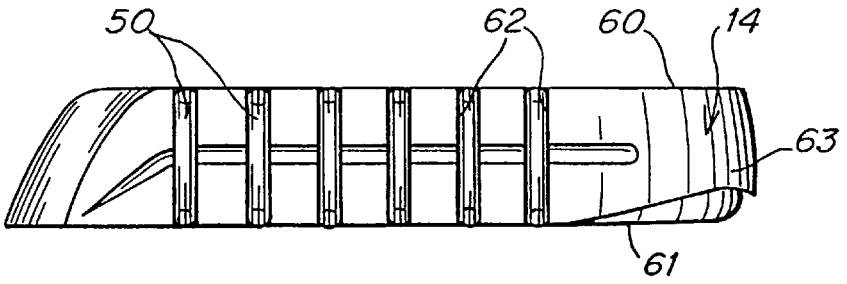
FIG. 3 is a plan side view of the midsole region taken along the lines 3—3 of FIG. 2.
Figure 4:
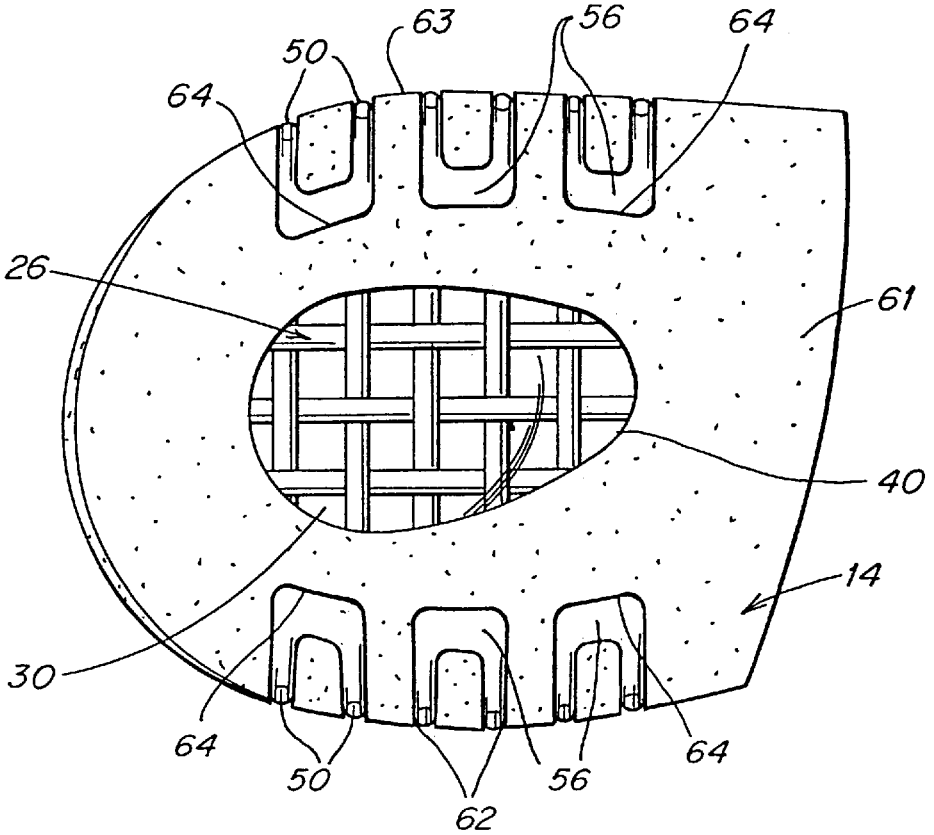
FIG. 4 is a plan bottom view of the present invention taken along the lines 4—4 of FIG. 1.

As best seen in FIGS. 2–4, grooves or channels 62 are molded along the sides 63 and bottom surface 61 of the midsole 14 to receive the strands 50 therein. The cap section 56 is also received in a groove 64 on the bottom surface 61 of the midsole 14. The arrangement of the cap section 56 and the groove 64 provides for a locking means for the strands 50 along the bottom surface 61 of the midsole 14. Contributing to this locking arrangement, of course, is the sole 12 of the shoe which is glued or cemented to the bottom of the midsole 14. Additionally, adhesive may be used to further secure the cap section 56 in position in the groove 64.

The operation of described embodiment will be discussed in conjunction with FIGS. 9–12. Upon first strike, FIG. 9, the foot impacts the lateral side of the midsole 14. Simultaneously, the midsole 14 and the strands 50 begin to compress. The strands 50 also begin to separate from the lateral side of the midsole during which the strand portion 70, which at rest abuts the lateral side 63 of the midsole 14, assumes an arcuate shape as the lateral side 63 of the midsole 14 remains compressed. This formation provides additional shock absorbing characteristics to the shoe on the lateral portion of the midsole 14.

The foot next rolls over the center portion of the heel section, FIG. 10, above the energy return cassette 20. In fact, FIG. 1 illustrates the foot just preceding the position shown in FIG. 10 since the rear most strands 50 are returning to a position abutting the lateral side of the midsole 14. Here, as the foot forces the net region 26 downward, the strands 50 are pulled inward along the channels 62. Since the cap sections 56 are secured in position in the grooves 64 on the bottom of the midsole 14, the tension in the strands 50 increases as the foot forces the net region 26 further downward. The strands provide support to the foot proportional to the amount of force being exerted on the cassette 20. In the present invention, the material of the strands 50, which is relatively non-elastic in comparison to the midsole 14 material, prevents the midsole from horizontal expansion. As a result, the midsole 14 is restricted and therefore the overall shape of the midsole is substantially maintained.

The present invention advantageously provides substantial support to the foot. First the strands 50 restrict the outward movement of the midsole 14 when the heel is in the center position over the cassette. The restriction on the outward movement on the midsole 14 keeps the midsole in a form substantially as originally manufactured thereby providing added stability.

It should be recognized that strands should substantially slow down the transverse motion of the foot so that there is reduced pronation during the gait cycle. Thus, while the preferred embodiment illustrates strands 50 over the medial portion, these strands 50 are more intended to maintain the structural integrity of the midsole 14 rather than to provide an energy return feature to the foot over the medial portion. However, if the foot does begin to pronate, as illustrated in FIG. 11, the tension between the strands 50 on the medial side of the shoe and the cassette 20 inhibits the foot from substantially pronating. Instead, the foot is guided back to the center position over the energy return cassette 20 for push off as shown in FIG. 12. At that point, the energy return features of the preferred embodiment are realized.

Various changes and modifications and equivalents of the embodiment described above and shown in the drawings may be made within the scope of this invention. Thus, it is intended that all matters contained in the above description or shown in the accompanying drawings are presented by way of example only and are intended to be interpreted in an illustrative and not limiting sense.

We claim:

1. A system for maintaining the stability of a shoe, comprising:

a compressible midsole having an inwardly facing wall defining a chamber, an upper surface, a bottom surface and a first and second outwardly facing side surfaces, a frame having an inner space adapted to rest on the upper surface of the midsole, a first plurality of strands attached to the frame and extending into the inner space of the frame to form a net, and a second plurality of non-rigid strands attached to the frame and extending beyond the frame, along the outwardly facing side surface and to the bottom surface of the midsole, said second plurality of strands having at least a portion securely mounted to the bottom surface of the midsole, whereby the second plurality of strands provide stability to the wearer during each aspect of ambulatory motion.

2. The combination of claim 1, wherein the second plurality of strands are molded to the frame.

3. The combination of claim 1, wherein the side surfaces include a plurality of grooves and one of the second plurality of strands is disposed within one of the plurality of grooves.

4. The combination of claim 1, wherein the bottom surface of the midsole includes a plurality of strand retention portions and each one of the second plurality of strands are coupled with an adjacent one of the second plurality of strands to form a loop which is retained by one of the plurality of strand retention portions.

5. The combination of claim 4, where the first plurality of strands forms a grid pattern.

6. The combination of claim 5, wherein the first side surface of the midsole is a lateral side of the shoe and the second side surface of the midsole is the medial side, wherein a portion of the second plurality of strands are disposed on the medial side and a portion of the plurality of strands are disposed on the lateral sides.

7. The combination of claim 6, wherein the portion of strands on the lateral are equal in number to the portion of the second plurality of strands on the medial side.

8. A shoe with enhanced stabilizing characteristics, comprising:

a compressible midsole having an inwardly facing wall defining a chamber, an upper surface, a bottom surface and first and second side surfaces, an outersole affixed to the bottom surface of the midsole, an energy return cassette mounted to the upper surface of the midsole, a plurality of non-rigid strands attached to the energy return cassette and extending over and in contact with the first and second side surfaces, said plurality of strands having ends securely disposed between and in contact with both the midsole bottom surface and the outersole, said plurality strands providing stability for the foot of a wearer during ambulatory motion.

9. The combination of claim 8, wherein the second plurality of strands are molded to the frame.

10. The combination of claim 8, wherein the side surfaces include a plurality of grooves and one of the second plurality of strands is disposed within one of the plurality of grooves.

* * * * *